US005517836A

United States Patent [19]

Hong

[11] Patent Number: 5,517,836

[45] Date of Patent: May 21, 1996

[54] FASTENING DEVICE PROVIDED WITH A COMBINATION LOCK

[76] Inventor: Chih-Cheng Hong, No. 303, Sec. 1, Park Road, Chang Hwa, Taiwan

[21] Appl. No.: 439,897

[22] Filed: May 12, 1995

[51] Int. Cl.[6] ..... E05B 37/02

[52] U.S. Cl. ..... 70/30; 70/57; 70/312

[58] Field of Search ..... 70/3–5, 57, 58, 70/30, 312, 69–72, 74; 292/19; 24/166, 625

[56] References Cited

U.S. PATENT DOCUMENTS

| | | | |
|---|---|---|---|
| 1,964,936 | 7/1934 | Denerich | 70/312 |
| 3,820,363 | 6/1974 | Bako et al. | 70/312 |
| 4,502,305 | 3/1985 | Bakker | 70/49 |
| 4,845,968 | 7/1989 | Lin | 70/312 |
| 4,912,950 | 4/1990 | Crowle | 70/58 |
| 5,117,663 | 6/1992 | Ida | 70/71 X |
| 5,193,368 | 3/1993 | Ling | 70/328 X |

*Primary Examiner*—Lloyd A. Gall
*Attorney, Agent, or Firm*—Browdy and Neimark

[57] ABSTRACT

A fastening device comprises a male retainer, a female retainer and a combination lock. The male retainer is made of a plastic material by injection molding and provided at one end thereof with a device engageable with a belt and at another end thereof with two retaining hooks. The female retainer is made of a plastic material by injection molding and provided at one end thereof with a device engageable with the retaining hooks of the male retainer. The female retainer has a hollow interior in which the combination lock is housed. The combination lock is provided with an arresting plate capable of preventing the retaining hooks from moving inwards when the process of locking the combination lock is under way. The arresting plate is provided with an arresting piece located between two retaining hooks and capable of being caused to move up and down by a numbered wheel of the combination lock so as to lock or unlock the fastening device.

5 Claims, 4 Drawing Sheets

FASTENING DEVICE PROVIDED WITH A COMBINATION LOCK

FIELD OF THE INVENTION

The present invention relates generally to a fastening device, and more particularly to the fastening device which is provided with a combination lock.

BACKGROUND OF THE INVENTION

The conventional fastening device is generally composed of a male retainer and a female retainer, which can be engaged or disengaged with each other. Such a conventional fastening device as described is used in conjunction with a fastening belt for securing an object such as a baggage.

The conventional fastening device is generally made of a plastic material by injection molding and can be used easily; nevertheless it is not theftproof and is therefore limited in use.

SUMMARY OF THE INVENTION

It is therefore the primary objective of the present invention to provide a fastening device with a combination lock.

It is another objective of the present invention to provide a fastening device, which is made up of two retaining means and a combination lock and is rather cost-effective.

In keeping with the principle of the present invention, the foregoing objectives of the present invention are attained by a fastening device comprising a male retainer, a female retainer, and a combination lock. The male retainer is made of a plastic material by injection molding and is provided at one end thereof with a means engageable with a belt. The male retainer is further provided at another end thereof with two parallel retaining hooks. The female retainer is made of a plastic material by injection molding and is provided at one end thereof with a means engageable with the retaining hooks of the male retainer. The female retainer is further provided with a receiving space in which the combination lock is disposed. The combination lock is provided with an arresting plate capable of preventing the retaining hooks from moving inwards when the process of locking the combination lock is under way. The arresting plate is provided with an arresting piece, which is located between two retaining hooks of the male retainer and is capable of being moved upwards and downward by a numbered wheel of the combination lock so as to lock or unlock the fastening device.

The foregoing objectives, features, functions and advantages of the present invention will be more readily understood upon a thoughtful deliberation of the following detaileld description of the present invention in conjunction with the accompanying drawings.

DETAILED DESCRIPTION OF THE INVENTION

Figure 1:
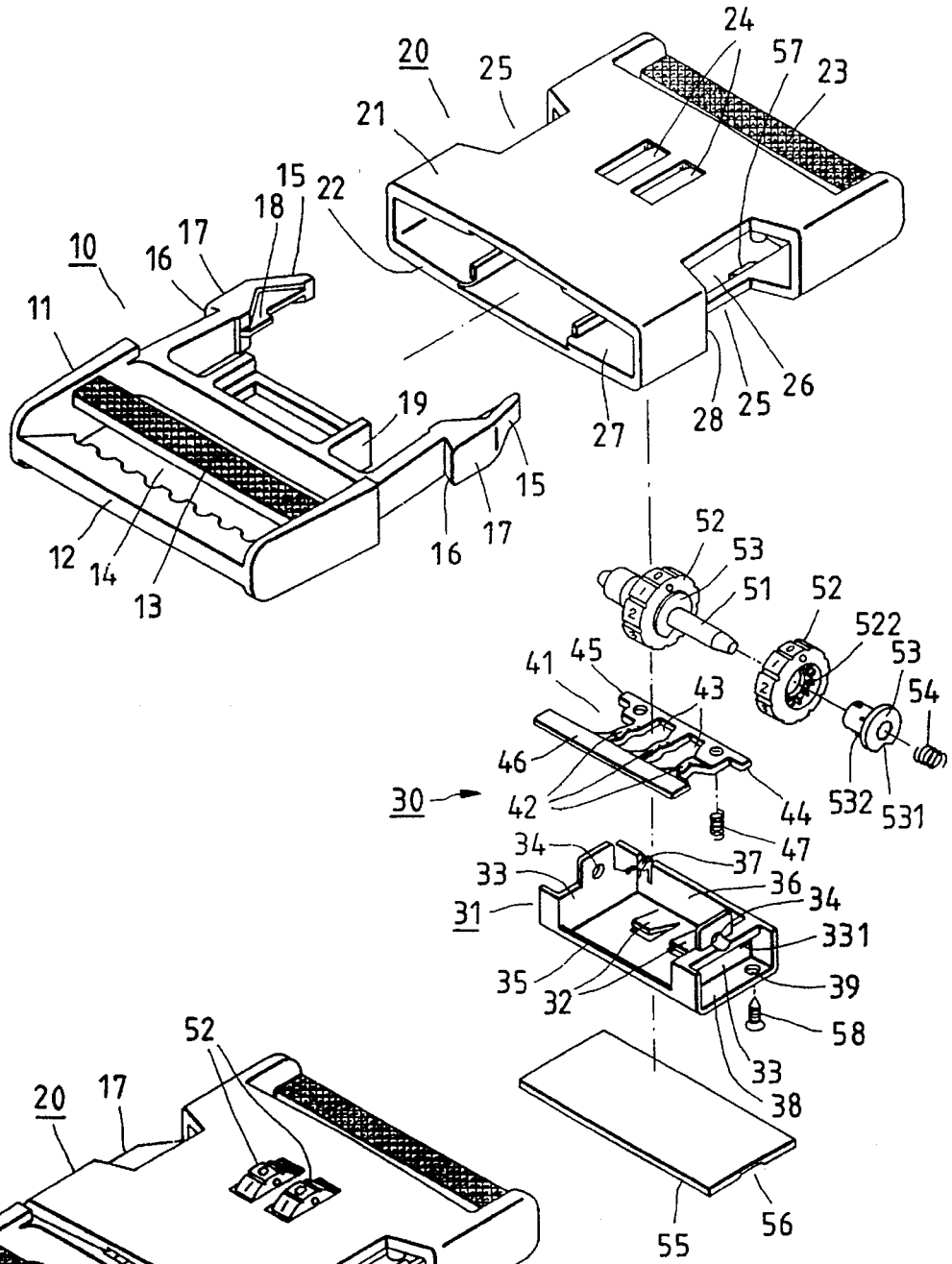
FIG. 1 shows an exploded view of a first preferred embodiment of the present invention.
Figure 2:
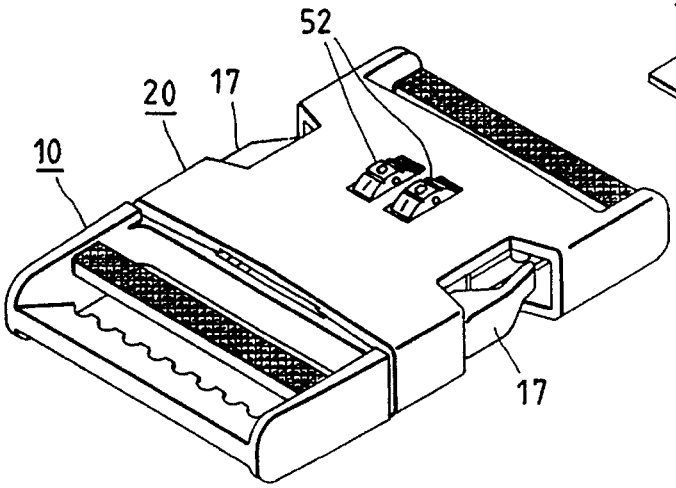
FIG. 2 shows a perspective view of the first preferred embodiment in combination according to the present invention.

As shown in FIGS. 1–5, a fastening device of the first preferred embodiment of the present invention comprises a male retainer 10, a female retainer 20, and a built-in combination lock 30.

The male retainer 10 is made integrally of a plastic material by injection molding and is composed of an outer frame 11 which is provided therein with two cross ribs 12 and 13, and with a fastening space 14 located between the two cross ribs 12 and 13 and intended for use in fastening therewith a belt of a fiber material. The outer frame 11 is provided on one side thereof with two retaining hooks 15 parallel to each other and corresponding in shape to each other. The retaining hooks 15 are provided respectively with a hooked portion 16 and a press portion 17 which is provided horizontally on the inner side thereof with a stopping or arresting portion 18 of an appropriate thickness. Located between the two retaining hooks 15 is a retaining frame 19 having a retaining hole 191 and a horizontal rib 192.

The female retainer 20 is made of a plastic material by injection molding and is provided therein a receiving space. The female retainer 20 comprises an upper frame piece 21, a lower frame piece 22, and a cross rib 23. The upper frame piece 21 is provided centrally with two slots 24 dimensioned to permit two numbered wheels to emerge therefrom to facilitate the dialing of the numbered wheels. The upper frame piece 21 is further provided respectively and correspondingly on two opposite sides thereof with a recessed area 25 into which the retaining hook 15 is extended. The lower frame piece 22 is provided with an opening 26 via which the combination lock 30 is disposed in the female retainer 20. The cross rib 23 is intended to secure thereto a flat belt of a fiber material. The female retainer 20 has an open end 27 through which the two retaining hooks 15 of the male retainer 10 are put such that the hooked portions 16 of the retaining hooks 15 are retained by the arresting portions 28 located at the bottoms of the recessed areas 25.

The combination lock 30 comprises a lock seat 31 made integrally of a plastic material by injection molding. The lock seat 31 is provided at the bottom thereof with two plastic resilient pieces 32 made integrally therewith and is further provided respectively at both ends thereof with an end plate 33 having a locating hole 331 and two pivot holes 34 located at the same level. The lock seat 31 is provided in one longitudinal side thereof with an opening 35 and in another longitudinal side thereof with a side plate 36 and two hooks 37. The lock seat 31 is further provided in the bottom plate 38 thereof with one or more round holes 39 for fastening the lock seat 31. The combination lock 30 further comprises an arresting plate 41 which is made of a metal material by punching and pressing and is provided centrally with three ribs 42 and two wheel holes 43. The arresting plate 41 is still further provided on one longitudinal side thereof with two locating pieces 44 and 45, and on another longitudinal side thereof with a retaining piece 46 extending therefrom in a curving manner to locate at the outside of the opening 35. The locating piece 44 is inserted into the locating hole 331 while the locating piece 45 is engaged securely with the hook 37. Located under the arresting plate 41 is a spring 47 for enabling the arresting plate 41 to swivel up and down by means of the locating pieces 44 and 45 serving as fulcrums. Two numbered wheels 52, two number-changing wheels 53 and a spring 54 are mounted on a shaft 51. The number-changing wheels 53 are provided respectively and peripherally with a notch 531. Before being located on the lock seat 31, the shaft 51 is fitted at both ends thereof into the pivot holes 34 of the end plates 33. The numbered wheels 52 are located via the wheel holes 43 by means of the plastic resilient pieces 32 such that one of the lattices on the numbered wheels 52 is retained securely by the resilient pieces 32 when the numbered wheels 52 are dialed for a number. The combination lock 30 is provided at the bottom thereof with a cover plate 55 which is intended to shield the opening 26 such that a recess 56 of the cover plate 55 is engaged securely with a locating projection 57 located near the opening 26.

In combination, the arresting plate 41, the numbered wheels 52, the number-changing wheels 53 and other component parts are assembled on the lock seat 31 to complete the formation of the combination lock 30, which is then disposed in the female retainer 20 via the opening 26. The combination lock 30 is housed in the female retainer 20 such that the upper half portions of the numbered wheels 52 are emerged via the slots 24 of the female retainer 20. The combination lock 30 is fastened securely in the female retainer 20 by a plurality of screws 58 via the round holes 39. The opening 26 of the female retainer 20 is covered with the cover plate 55.

Figure 3:
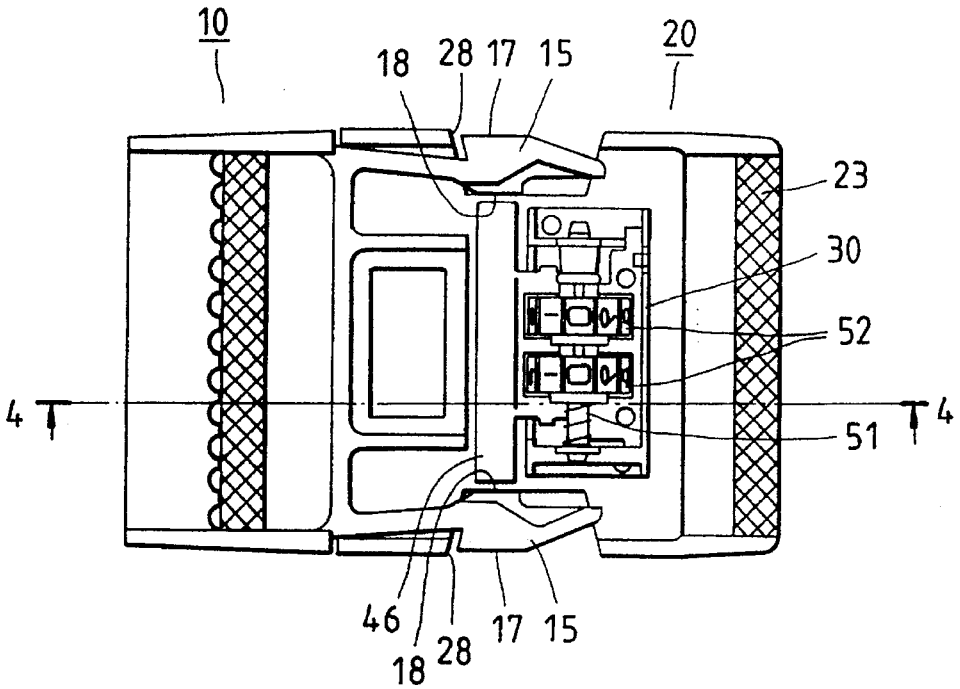
FIG. 3 shows a horizontal sectional view of the preferred embodiment as shown in FIG. 2.
Figure 4:
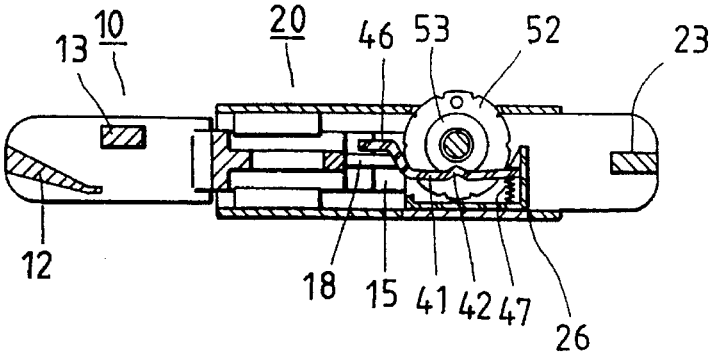
FIG. 4 is a sectional view taken an long the line 4—4, as shown in FIG. 3, to illustrate the unlocking state of the first preferred embodiment.

In operation, the male retainer 10 and the female retainer 20 are coupled by inserting the retaining hooks 15 into the female retainer 20 via the open end 27 such that the hooked portions 16 of the retaining hooks 15 are engaged securely with the arresting portions 28 of the female retainer 20. In the meantime, the combination lock 30 remains in the unlocking state, as shown in FIGS. 3 and 4. As the press portions 17 of the retaining hooks 15 are pressed, the retaining piece 46 is located at an upper position so that the retaining piece 46 can not be touched by the stopping portions 18. As a result, the retaining hooks 15 can be pressed toward the female retainer 20 so as to cause the hooked portions 16 to become disengaged from the arresting portion 28, thereby resulting in the disengagement of the male retainer 10 from the female retainer 20.

Figure 5:
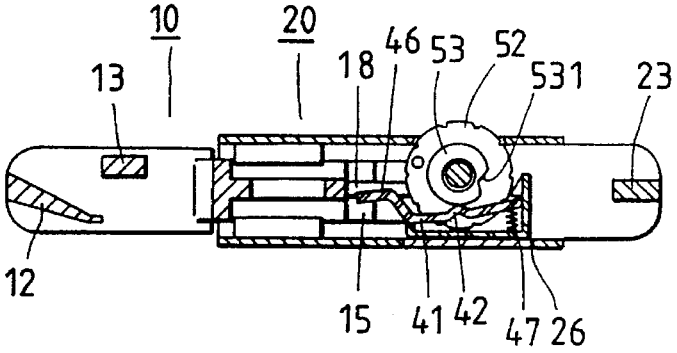
FIG. 5 is a Sectional view taken along the line 4—4, as shown in FIG, 3, to illustrate the locking state of the first preferred embodiment.
Figure 6:
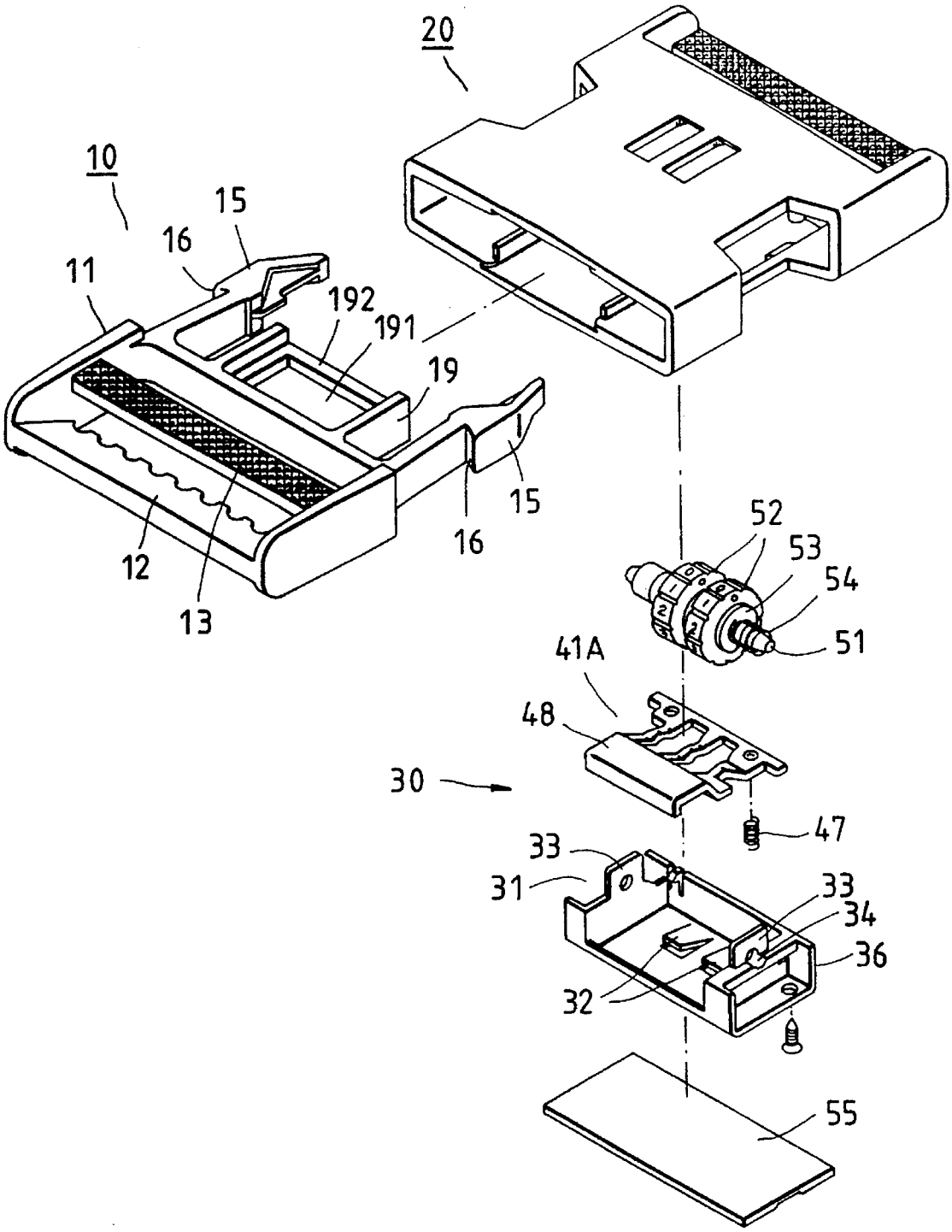
FIG. 6 shows an exploded view of a second preferred embodiment of the present invention.
Figure 7:
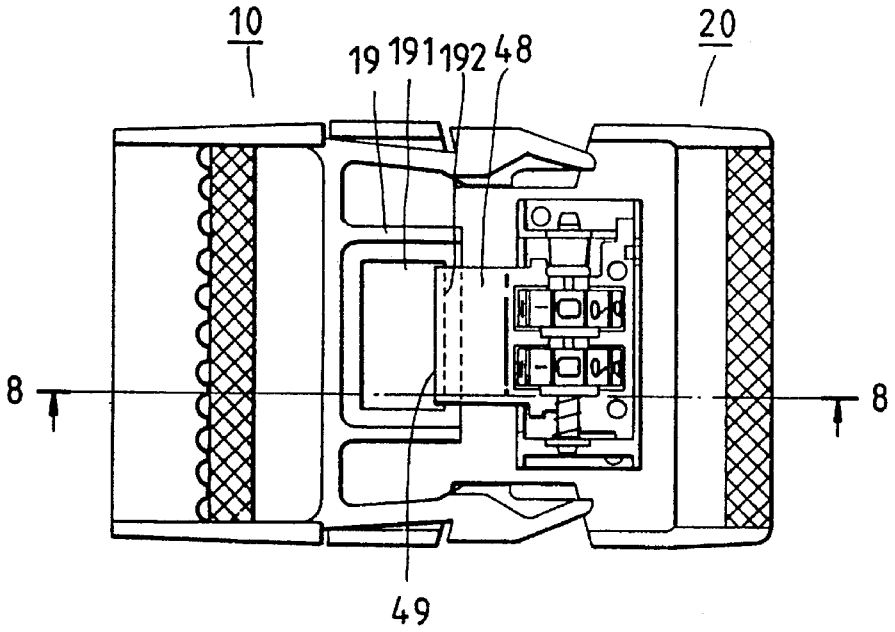
FIG. 7 shows a sectional view of the second preferred embodiment in combination according to the present invention.

When the numbered wheels 52 of the combination lock 30 are turned at random, the position of the notch 531 of the number-changing wheel 53 is no longer located on a straight line perpendicular to the upper surface of the cover plate 55, as shown in FIG. 5. As a result, the corrugated ribs 42 of the arresting plate 41 are forced to displace downwards, thereby causing the retaining piece 46 to move downwards to locate between two stopping portions 18 of the retaining hooks 15. For this reason, the retaining hooks 15 can not be pressed inwards in view of the fact that the retaining piece 46 is touched by the stopping portion 18 when the press portions 17 of the retaining hooks 15 are pressed inwardly. In other words, the hooked portions 16 of the retaining hooks 15 can not be caused to disengage the arresting portion 28. As a result, the male retainer 10 can not be disengaged from the female retainer 20 unless the numbered wheels 52 are so rotated as to form a set series of numbers to work the mechanism that unlocks the combination lock 30.

The set series of numbers of the combination lock 30 can be altered by using a slender bar to press the left end of the shaft 51 via a side hole (not shown in the drawing) of the female retainer 20, thereby causing the toothed portion 532 of the number-changing wheel 53 to disengage the serrated portion 522 of the numbered wheel 52 so as to enable the numbered wheels 52 to be rotated to form a new set series of numbers before the shaft 51 is relieved of the pressure of the slender bar to permit the number-changing wheels 53 to engage the serrated portions 522 of the numbered wheels 52. Such a design as described above is similar to the prior art combination lock.

As shown in FIGS. 6–9, the second preferred embodiment of the present invention comprises mainly a male retainer 10, a female retainer 20 and a combination lock 30. The male retainer 10 has an outer frame 11, two cross ribs 12 and 13, and two retaining hooks 15 which are provided respectively with a hooked portion 16 and a retaining frame 19. The female retainer 20 is similar in construction to the first preferred embodiment of the present invention and has an upper frame piece 21, a lower frame piece 22 and a cross rib 23. The upper frame piece 21 is provided with two slots 24, two recessed areas 25 and an arresting portion 28. The lower frame piece 22 has an opening 26. The combination lock 30 has a lock seat 31 similar in construction to the lock seat of the first preferred embodiment described above, an arresting plate 41A, a shaft 51, two numbered wheels 52, and two number-changing wheels 53. The arresting plate 41A of the second preferred embodiment is different from the arresting plate 41 of the first preferred embodiment in that the former has a retaining piece 48 which has a relatively narrow width and is separated from the retaining hooks 15 at an appropriate interval. In addition, the retaining piece 48 is provided at the outermost end thereof with a curved arresting hook 49.

Figure 8:
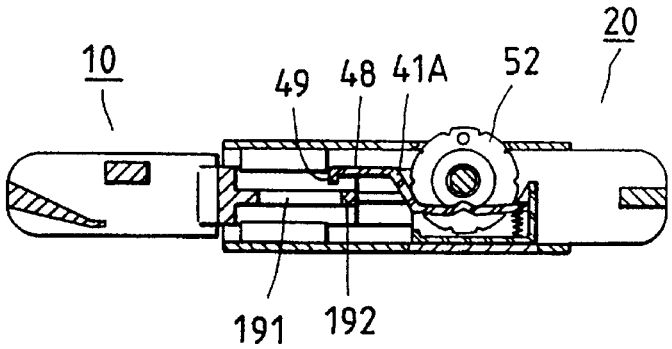
FIG. 8 is a sectional view taken along the line 8—8, as shown in FIG. 7, to illustrate the unlocking state of the second preferred embodiment.
Figure 9:
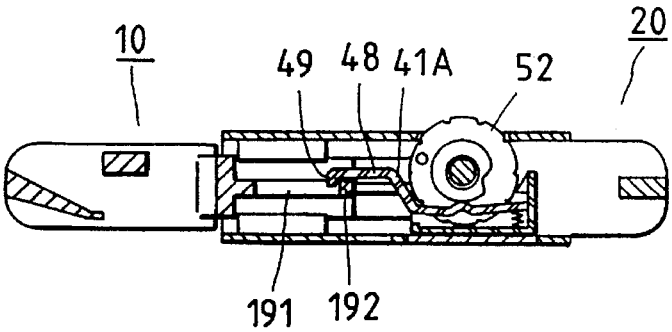
FIG. 9 is a sectional view taken along the line 8—8, as shown in FIG. 7, to illustrate the locking state of the second preferred embodiment.

The second preferred embodiment of the present invention is further different from the first preferred embodiment of the present invention in that the arresting plate 41A is located at the upper portion of the female retainer 20, as shown in FIG. 8, when the combination lock 30 remains in the unlocking state. As a result, the arresting hook 49 is not engaged with a retaining hole 191 of the retaining frame 19. When the combination lock 30 remains in the locking state, the arresting hook 49 is engaged with the retaining hole 191 of the retaining frame 19 and with the cross rib 192, as shown in FIG. 9. In the meantime, the male retainer 10 and the female retainer 20 can not be caused to disengage with each other even if the retaining hooks 15 are pressed.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A fastening device provided with a combination lock comprising:

a male retainer made integrally of a plastic material and provided at one side thereof with two retaining means having respectively a hooked portion, and a female retainer made integrally of a plastic material and provided with an upper frame piece, a lower frame piece, and a hollow interior formed between said upper frame piece and said lower frame piece, said female retainer further provided therein with an arresting means engageable with said hooked portions of said two retaining means of said male retainer, said hooked portions being elastically inwardly movable toward one another for releasing the engagement thereof from said arresting means;

wherein said hollow interior of said female retainer is provided with a combination lock comprising a lock seat on which an arresting plate, a shaft, a plurality of numbered wheels, and a plurality of number-changing wheels are mounted, said numbered wheels having respectively a periphery which is emerged via a slot of said upper frame piece of said female retainer to facilitate the turning of said numbered wheels with one's finger, said arresting plate being mounted on said lock seat such that said arresting plate is pressed by said numbered wheels and said number-changing wheels, said arresting plate having a retaining piece extending to locate between said hooked portions of said male retainer, said retaining piece capable of being forced to move up and down by a rotational motion of said numbered wheels so as to become engageable with or disengageable from an arresting means of said male retainer.

2. The fastening device as defined in claim 1, wherein said two retaining means of said male retainer are provided respectively and oppositely with an arresting portion; wherein said retaining piece of said arresting plate has a width which is smaller than a distance separating said two arresting portions of said two retaining means; and wherein said retaining piece is held securely between said two arresting portions so as to unable said two retaining means to be moved inwardly when said combination lock is in a locking state.

3. The fastening device as defined in claim 1, wherein said male retainer is provided with a retaining frame located between said two retaining means and provided with a retaining hole; and wherein said retaining piece of said arresting plate is provided at an outermost end thereof with a curved retaining hook engageable with said retaining hole when said combination lock is in a looking state.

4. The fastening device as defined in claim 1, wherein said lower frame piece of said female retainer is provided with an opening through which said combination lock is mounted in said hollow interior of said female retainer, said opening provided with a cover.

5. The fastening device as defined in claim 1, wherein said lock seat of said combination lock is made integrally of a plastic material and provided on a bottom plate thereof with a plurality of resilient elements of a plastic material and with a plurality of frame plates and pivot holes for locating said combination lock.

* * * * *